United States Patent [19]

Van Doorselaer

[11] 4,130,428

[45] Dec. 19, 1978

[54] COMBINATION OF PHOTOSENSITIVE ELEMENTS SUITED FOR USE IN RADIOGRAPHY

[75] Inventor: Marcel K. Van Doorselaer, 's-Gravenwezel, Belgium

[73] Assignee: AGFA-GEVAERT, N.V., Mortsel, Belgium

[21] Appl. No.: 624,259

[22] Filed: Oct. 20, 1975

Related U.S. Application Data

[63] Continuation-in-part of Ser. No. 303,384, Nov. 3, 1972, abandoned.

[30] Foreign Application Priority Data

Nov. 5, 1971 [GB] United Kingdom ..... 51628/71
May 31, 1972 [GB] United Kingdom ..... 25529/72

[51] Int. Cl.[2] ..... G03C 1/92; G03C 1/76

[52] U.S. Cl. ..... 96/68; 96/45.1; 96/82; 250/320; 250/475; 250/482; 250/483; 250/484; 250/486

[58] Field of Search ..... 96/45.1, 82, 84, 94, 96/68; 250/320, 458, 475, 482, 483, 484, 486

[56] References Cited

U.S. PATENT DOCUMENTS

| | | | |
|---|---|---|---|
| T882,014 | 1/1971 | Rees et al. | 96/82 |
| 3,300,311 | 1/1967 | Kennard et al. | 96/82 |
| 3,418,247 | 12/1968 | Yocum et al. | 252/301.4 |
| 3,546,128 | 12/1970 | Rabatin | 252/301.4 |
| 3,617,285 | 11/1971 | Staudenmayer | 96/82 |
| 3,712,827 | 1/1973 | Gramza | 96/82 |
| 3,734,735 | 5/1973 | Bories | 96/82 |
| 3,737,313 | 6/1973 | Rosecrants et al. | 96/45.1 X |
| 3,753,714 | 8/1973 | Sugiyama et al. | 96/82 X |
| 3,822,131 | 7/1974 | Cleare | 96/82 |
| 3,883,747 | 5/1975 | Murashige et al. | 250/483 |
| 3,912,933 | 10/1975 | Van Stappen | 96/82 X |
| 3,945,822 | 3/1976 | Verhille | 96/1 R |

*Primary Examiner*—Edward C. Kimlin
*Attorney, Agent, or Firm*—A. W. Breiner

[57] ABSTRACT

A combination suitable for radiography comprising two separate x-ray fluorescent screens and a photosensitive material comprising a support with a silver halide layer coated on each surface of said support, wherein each of the fluorescent screens is arranged adjacent to one of the silver halide layers. The maximum emission of the x-ray screen is in the wavelength range of 450–570 nm, while the silver halide layers are sensitive to light in the same wavelength range.

25 Claims, No Drawings

COMBINATION OF PHOTOSENSITIVE ELEMENTS SUITED FOR USE IN RADIOGRAPHY

This application is a continuation-in-part of copending application Ser. No. 303,384 filed Nov. 3, 1972, now abandoned.

The present invention relates to an improved combination of photosensitive elements suited for use in radiography and more particularly to a combination comprising an X-ray intensifying screen of the fluorescent type and a silver halide recording element.

In medical radiography it is important that the time to dispose of the recorded information be as short as possible. Therefore the exposed radiographic silver halide materials should be processed in a minimum of time.

It is generally known that processing times and more particularly the fixing times can be shortened by using silver halide emulsions having a relatively small amount of silver halide per unit of surface. The use of photographic materials with a small silver halide content brings about, however, that the maximum density, the contrast and the resolving power of the obtained image are at a rather low level.

In this connection it is interesting to note that fine-grained silver halide emulsions have a higher covering power than coarse-grained emulsions (ref. P. Glafkidès, Photographic Chemistry, Vol. I (1958) 89–90).

By the term "covering power" is understood in the present invention the reciprocal of the photographic equivalent of developed silver, i.e. the number of grams of silver per sq. decimeter, divided by the maximum optical density obtained.

Fine-grained emulsions have a lower photographic speed, however, and consequently the use of such types of emulsions requires an exposure that may surpass the permissible dose applied in medical X-ray photography.

From the published German patent application No. 2,051,262 a radiographic recording combination is known comprising:

(A) an X-ray intensifying screen having more than half of its spectral emission at less than about 410 nm, (B) an element comprising a support, and (C) silver halide being capable of producing a negative image in situ, having a covering power greater than about 50, and being present in an equivalent concentration of less than about 0.080 gram of silver per square decimeter.

By the fact that the intensifying screens used in that combination have more than half of their spectral emission below 410 nm they are emitting in the inherent spectral sensitivity range of the known types of photosensitive silver halide. This practical optimum matching of inherent absorption spectrum of the silver halide and the emission spectrum of the applied fluorescent screen makes it possible to use the above defined silver halide containing element with a silver halide coverage of less than about 0.080 gram of silver per square decimeter and possible covering power greater than about 50, without increasing the radiation dose too much.

A disadvantage of the recording materials having poor silver halide content lies in the increase of "cross-over", a phenomenon associated with silver halide emulsion materials carrying at both sides of a support that is transparent for fluorescent light a silver halide emulsion layer, which during the X-ray exposure stands in close contact with a fluorescent screen.

Indeed, the light emitted by one of these fluorescent screens, gives rise not only to an image-wise blackening in the adjacent silver halide emulsion layer, but penetrates also in a considerable amount through the relatively thick support and produces an unsharp image in the oppositely situated silver halide emulsion layer. This phenomenon is called "cross-over". The degree of cross-over substantially determines the image quality of the image obtained in the radiographic recording material.

The cross-over image is unsharp because of the diffusion of light in the different layers and support sheet of the recording material and also because of the diffuse refraction and reflection of light taking place at the boundaries of said layers and support sheet.

In common radiographic materials a relatively high amount of silver halide is used per unit of surface in order to obtain a sufficient contrast, maximum density and this generally results in a fairly low cross-over.

It has been proposed in the United Kingdom patent specification No. 821,352 to improve the image sharpness of reducing the cross-over light by incorporating filtering dyes in the film support and/or the substrate layers or intermediate layers of the film. The colouring obtained with these dyes is complementary to the colour of the fluorescent light of the particular intensifying screen used.

In practice this has been realized by using a blue-fluorescent calcium tungstate intensifying screen and a silver halide material containing in its support a yellow dye.

The good inherent absorption by the silver halide grains of light with a wavelength below 410 nm and the strong light scattering of ultraviolet light through the dispersed silver halide particles of an emulsion layer, i.e., following the rule the shorter the wavelength of light, the stronger the light scattering, permits using screens having more than half of its spectral emission at less than about 410 nm in combination with a double-sided silver halide material without having a large amount of light of each X-ray intensifying screen cross-over to the opposite emulsion layer, thus providing an image having good or permissible sharpness. At times, however, there is an advantage and it is desirable to operate in the visible light area of the medium wavelength range, that is green light.

In this connection the attention is drawn to the U.S. Pat. No. 3,396,024 from which is known that the gamma response of a light-sensitive silver halide emulsion layer depends on the colour of the light to which the layer is exposed. Thus, the gradation of spectrally sensitized silver halide emulsion layers is steeper in the region of spectral sensitization than in the region of the natural blue sensitivity of the silver halide. This property results from the fact that small silver halide grains are more strongly sensitized by absorbing sensitizing dyestuffs than larger grains. In the field of X-ray photography in which the production of contrasty images is desirable the use of green light emitting screens offers a desirable advantage.

Another advantage of operating with green light stems from the fact that green light is much less chemically active than ultra-violet light and will not cause yellowing and/or photodegradation of the binding agent(s) of the fluorescent screens.

However, green light was considered to give rise to an unacceptable cross-over not permitting its practical application in conjunction with double side coated silver halide materials especially when these are of low silver halide content.

It is an object of this invention to provide a novel radiographic combination of two separate fluorescent screens each of which is arranged adjacent to a silver halide emulsion layer of a particular photosensitive element of the double-side coated type which combination is capable of yielding radiographs that have a commercially acceptable image sharpness though obtained with mainly visible light of the medium wavelength range viz. green light.

It is another object of this invention to provide a novel radiographic combination of a fluorescent screen and a photosensitive element of low silver halide coverage, capable of yielding a visible image with a favourable relationship between modulation transfer function (MTF) value and speed.

It is still another object of this invention to provide a radiographic process wherein the time required to obtain a developed image is reduced and the effective life of the processing solutions is prolonged.

Other objects of this invention will become apparent from an examination of the further description.

In accordance with the present invention a combination of photosensitive materials suited for radiography is provided comprising :

(1) at least one X-ray fluorescent intensifying screen material having more than half its spectral emission above about 410 nm and its maximum of emission in the wavelength range of 450–570 nm and having an intensification factor of at least 20 at 40 kV and at least 25 at 80 kV;

(2) a photosensitive material comprising a support and incorporating in one or more layers silver halide that is capable of yielding by development a visible silver image having a covering power of more than about 50, said silver halide being present in an amount equivalent to less than 8 g of silver per sq.m and being spectrally sensitized with (a) sensitizing dye(s) in such a way that it is sensitive for light in the wavelength range of 450–570 nm.

In accordance with a preferred embodiment of the present invention a combination of photosensitive materials suited for radiography is provided comprising:

(1) two separate fluorescent screens each of which has more than half of its spectral emission above 410 nm and its maximum of emission in the wavelength range of 450–570 nm and an intensification factor of at least 20 at 40 kV and at least 25 at 80 kV;

(2) a photosensitive material comprising a support and at both sides of said support a layer of silver halide, the silver halide being capable of yielding by development a visible, negative silver image, a covering power of more than about 50, and being present in each layer in a corresponding equivalent amount of less than about 4 g of silver per square meter and being spectrally sensitized with (a) sensitizing dye(s) in such a way that it is sensitive for light in the wavelength range of 450–570 nm, and each of said fluorescent screens being arranged adjacent to one of said emulsion layers.

Modulation transfer function (MTF) is a characteristic which represents the resolving power of a photographic element or system of elements independently of subject contrast (see e.g. SPSE Handbook of Photographic Science and Engineering, edited by Woodlief Thomas, Ir. John Wiley & Sons, pages 942–943 [1973]).

By the term "radiography" we designate a recording technique that makes use of penetrating radiation, which includes highly energetic radiation such as X-rays, $\gamma$-rays, $\beta$-rays and fast electrons, e.g. as obtained in an electron microscope.

By "intensification factor" is to be understood a factor measured at a pre-elected density D, indicating the exposure required to produce this density when the film is exposed to X-rays without intensifying screen, divided by the exposure required to produce the same density, e.g. density D = 1.00, when the film is exposed with the screen, the wavelength distribution of the radiation and the conditions of development being maintained constant.

In the radiographic combination of X-ray fluorescent screens and spectrally sensitized radiographic materials of the present invention, the said screens may be arranged separately from the radiation-sensitive silver halide material or it may form with the silver halide emulsion an integral arrangement so that on one and the same support both the silver halide emulsion and the X-ray fluorescent screen are provided. The radiographic material may be a single- or double-coated radiographic material, which means that the radiographic material comprises either at only one side or at both sides of the support radiation sensitive silver halide emulsion. The fluorescent screens may be provided at both sides of a single- or double-coated radiographic material. The radiographic combination of fluorescent screens and radiographic silver halide materials may comprise the common intermediate and/or protective and/or stripping layers, which may be arranged between or over the radiation-sensitive emulsions and the fluorescent screens.

The phosphors or fluorescing substances used in the visible light-emitting fluorescent screens applied in the present invention are, e.g., substances containing materials of the elements with atomic number 39 or 57 to 71, which include yttrium, gadolinium, lanthanum, cerium, etc. Particularly suitable are the rare earth oxysulphide and oxyhalide fluorescing materials activated with other selected rare earths e.g. lanthanum, and gadolinium oxybromide and oxychloride activated with terbium or dysprosium, and lanthanum and gadolinium oxysulphides activated with terbium, europium, or a mixture of europium and samarium. These rare earth fluorescent materials have been extensively described in the recent literature for which we refer e.g. to German patent specification No. 1,282,819, French patent specification Nos. 1,540,341-1,580,544 and 2,021,397, French Patent of Addition Nos. 94,579 to 1,473,531, U.S. Pat. No. 3,546,128 and to K. A. Wickersheim et al. "Rare Earth Oxysulphide X-ray Phosphors", IEEE Nuclear Science Symposium, San Francisco, October 29–31, 1969 and to R. A. Buchanan IEEE Transactions on Nuclear Science, February 1972, pages 81–83. These rare earth photoluminescent materials especially the gadolinium and lanthanum oxysulphides and oxyhalides activated with other selected rare earths e.g. erbium, terbium and dysprosium have a high X-ray "stopping power" or average absorption and high emission density and enable radiologists to use substantially lower X-ray dosage levels.

Practically suited phosphors for use in the fluorescing intensification screens applied in the present invention correspond to the following general formula:

$$M_{(w-n)}M'_n O_w X$$

wherein :

M is at least one of the metals yttrium, lanthanum, gadolinium or lutetium,

M' is at least one of the rare earth metals dysprosium, erbium, europium, holmium, neodymium, praseodymium, samarium, terbium, thullium or ytterbium, X is sulphur or halogen, n is 0.0002 to 0.2, and w is 1 when X is halogen or is 2 when X is sulphur.

The preparation of fluorescent substances falling within the scope of that general formula has been described e.g., in the French patent specification No. 1,580,544, in the U.S. Pat. Nos. 3,418,246 and 3,418,247 and in the United Kingdom patent specification No. 1,247,602.

A fluorescent screen containing a mixture of (A) yttrium oxysulphide activated with from 0.1 to 10% by weight of terbium or activated with terbium and dysprosium, and (B) gadolinium or lanthanum or lutetium oxysulphide activated with terbium or dysprosium is particularly useful for its high visible light emission capacity.

A preferred ratio by weight of (A) and (B) is 25:75.

In combination with silver halide emulsion layers that are spectrally sensitized in the wavelength range of 450–570 nm preferably terbium-activated gadolinium or lanthanum oxysulphides having emission peaks at 490 and 540 nm and falling within the scope of the above general formula are used.

Other suitable intensification screens containing fluorescent materials that emit green light when exposed to cathode rays and X-ray radiations are described in United Kingdom patent specification No. 1,248,968.

The selected fluorescent substance(s) is (are) in the form of a layer applied to a support or applied as a self-supporting layer or sheet. Suited layers or sheets have a thickness of preferably 0.05 to 0.5 mm and contain the fluorescent substance(s) or phosphors dispersed in a binder. Such binder is, e.g., or organic high molecular weight polymer. Preferred binding agents are, e.g., cellulose nitrate, ethylcellulose, cellulose acetate, polyvinyl acetate, polystyrene, polyvinylbutyral, polymethyl methacrylate and the like.

The proportion of high molecular weight polymer to fluorescent material is in general within the range of 5–15 % by weight. A preferred grain size of the fluorescent substances is preferably in the range of about 1–25 μ.

The surface of the fluorescent material layer may be protected against moisture and mechanical damage by a coating of an organic high polymer applied to a thickness of 0.001 to 0.05 mm. Such protecting coating is, e.g., a thin film of cellulose nitrate, cellulose acetate, polymethyl methacrylate and the like.

Besides the fluorescent lighting impinging normally to the silver halide layer there is always an amount of diffuse radiation in the fluorescent screen giving rise to image unsharpness. The image sharpness can be improved considerably by incorporating a fluorescent light-absorbing dye called here "screening dye" into the fluorescent screen material e.g. in the fluorescent layer or into a layer adjacent thereto e.g. antihalation layer or covering layer. As the oblique radiation covers a larger path in the screen material it is attenuated by the screening dye or dyes to a greater extent than the radiation impinging normally. The term "screening dye" includes here dyestuffs (i.e. coloured substances in molecularly divided form) as well as pigments.

Diffuse radiation reflecting from the support of the fluorescent screen material is mainly attenuated in an antihalation layer containing the screening dyes subjacent to the fluorescent layer.

The use of screening dyes in a covering layer to the fluorescent layer mainly reduces the strength of the obliquely emitted light originating from the fluorescent layer.

An appropriate screening dye for use in the fluorescent screens emitting in the green part (500–600 nm) of the visible spectrum is, e.g., Neozapon Fire Red (C.I. Solvent Red 119), an azochromium rhodamine complex. Other suitable screening dyes are : C.I. Solvent Red 8, 25, 30, 31, 32, 35, 71, 98, 99, 100, 102, 109, 110, 118, 124 and 130.

The screening dye has not to be removed from the fluorescent screen material and therefor may be any dye or pigment absorbing in the emission spectrum of the fluorescent substance(s). Thus a black substance such as carbon black incorporated in the antihalation layer of the screen material yields quite satisfactory results.

The screening dye(s) is (are) preferably used in the antihalation layer in an amount of at least 0.5 mg per sq.m. Their amount in the anti-halation layer, however, is not limited.

Very good results are obtained with the screening dye(s) in the antihalation layer and in the layer containing the fluorescent substances. In that case the fluorescent layer contains e.g. the screening dye or dyes in an amount of 5 mg per sq.m. The amount of screening dye(s) in the fluorescent layer and/or covering layer may be adapted to the results of image sharpness and radiation aimed at.

In order to diminish the cross-over, at least one layer and/or the base material of the light-sensitive material of the present invention should preferably contain a filtering dye absorbing light in the wavelength range emitted by the fluorescent screen used in the combination.

The dyes used in the silver halide emulsion recording material called hereinafter "filtering dyes" are preferably incorporated in the hydrophilic colloid layer between the silver halide emulsion layers or in the emulsion layers themselves. The dyes have, however, preferably such chemical and/or physical characteristics that they can be removed or decolourized in one of the processing baths. The filtering dyes may, however, also be incorporated in one or more subbing layers and even in the support e.g. giving it a blue aspect e.g. offering it a specular absorption density that may reach 0.45 in the 480–700 nm wavelength range. Commercial blue supports for double-sided X-ray silver halide materials have a spectral density in the range of about 0.1 to about 0.2 in the 500 to 580 nm wavelength region.

According to a preferred embodiment of the present invention filtering dyes absorbing in the wavelength range of about 450 to 600 nm are used when fluorescent screens are applied that substantially emit light in the wavelength range of 450–570 nm.

The amount of filtering dye is preferably in the range of 25 to 1000 mg per sq.m but here likewise lower or higher amounts may be appropriate according to the result aimed at.

A reduction of about 20% of the cross-over of green light, more particularly of light in the wavelength range of 500 to 570 nm is obtained by using the "blue" coloured supports of commercially available double-side coated silver halide X-ray materials e.g. CURIX RP1

(CURIX is a registered trademark of Agfa-Gevaert Antwerp/Leverkusen).
Suitable filtering dyes that can be removed from hydrophilic colloid layers are e.g. those listed in table 1.
Table 1
1.
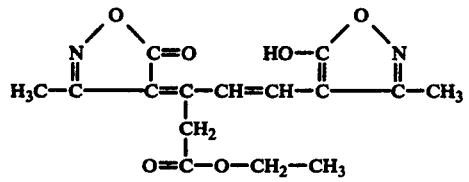
2.
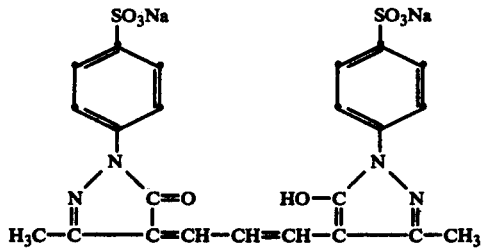
3.
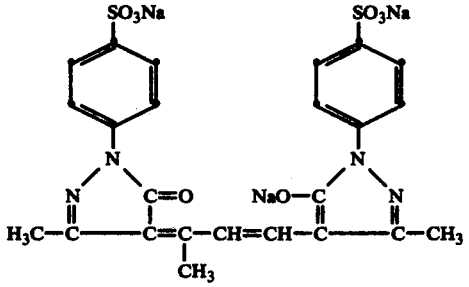
4.
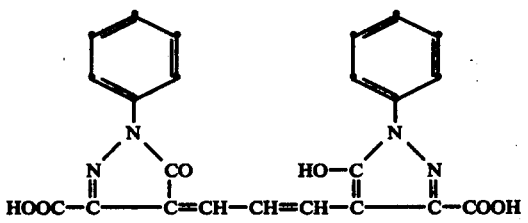
5.
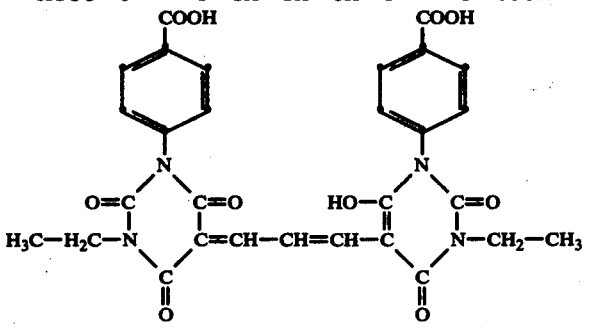
6.
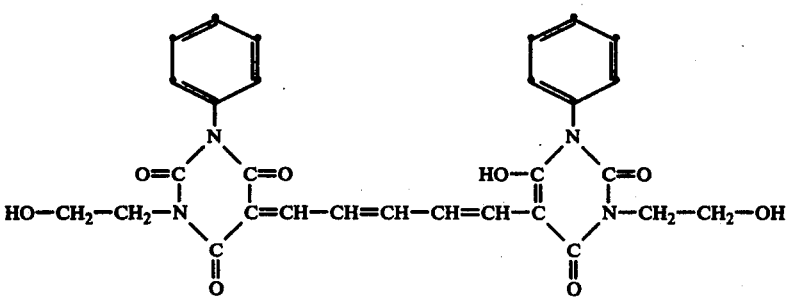

Table 1-continued

7.

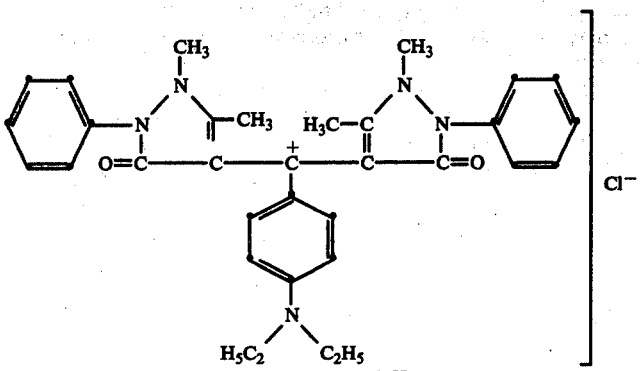

8.

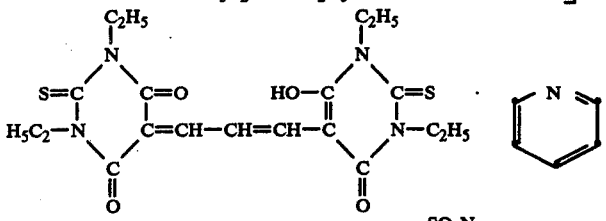

9.

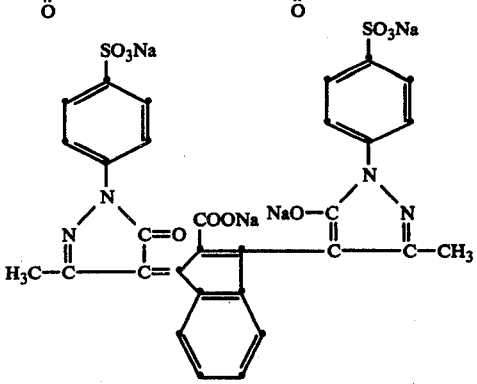

10.

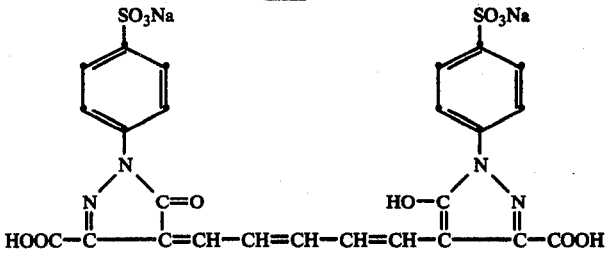

11.

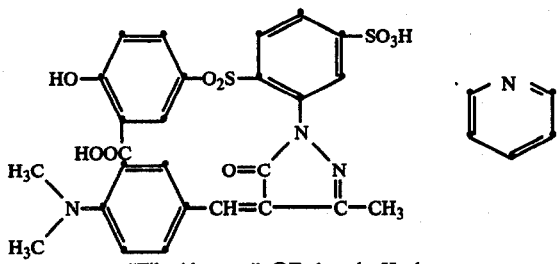

"Filterblaugrun" ®Farbwerke Hochst

The radiographic combinations of our invention employ in addition to the fluorescent screen an element comprising a suitable support bearing a properly spectrally sensitized silver halide. Said silver halide may be present in a layer or coating such as a single coating or a duplitized or dual coating, i.e. in a material having a silver halide emulsion layer on each side of a support. Suitable supports are those having the properties to permit their ready passage through a rapid automatic processor. The support should therefore be reasonably flexible and preferably transparent but able to maintain the dimensional stability and integrity of the various coatings thereon. Typical film supports are cellulose nitrate, cellulose ester, polyvinyl acetal, polystyrene, polyethylene terephthalate, and the like. Supports such as cards or paper that are coated with α-olefin polymers, particularly polymers of α-olefins containing two or more carbon atoms, as exemplified by polyethylene, polypropylene, ethylenebutene copolymers and the like, give good results.

The silver halide emulsions may be spectrally sensitized by any of the known procedures. They may be spectrally sensitized by means of common spectrally sensitizing dyes used in silver halide emulsions, which include cyanine dyes and merocyanine dyes as well as other dyes as described by F. M. Hamer in "The Cyanine Dyes and related Compounds", Interscience Publishers (1964). These dyes are preferably used in an amount in the range of 20 mg to 250 mg per mole of silver halide. The higher the amount of sensitizing dye the lower the cross-over and the better the image sharpness.

Suitable spectral sensitizing dyes for silver halide to be used in the combination with screens emitting light in the wavelength range of 480–570 nm are listed for illustrative purposes in the following table 2.

Table 2

1.

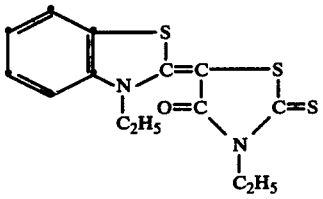

2.

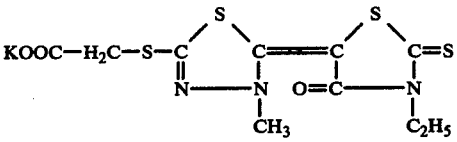

3.

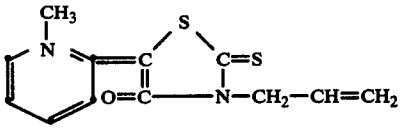

4.

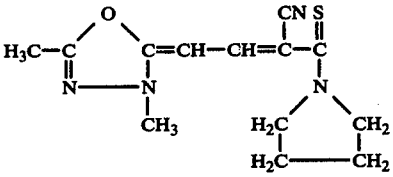

5.

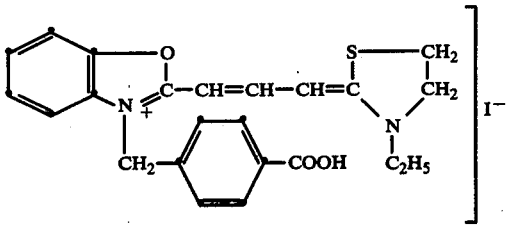

6.

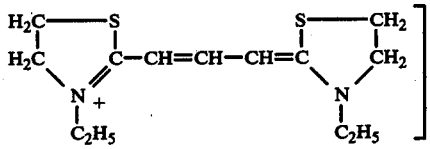

7.

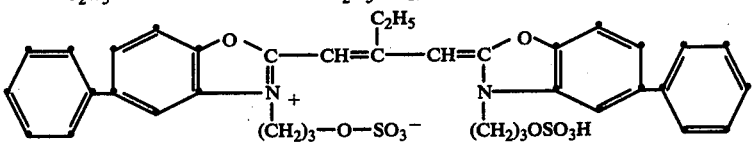

8.

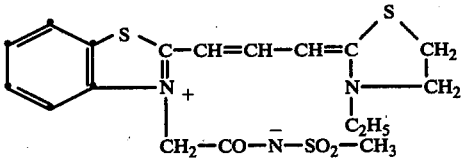

9.

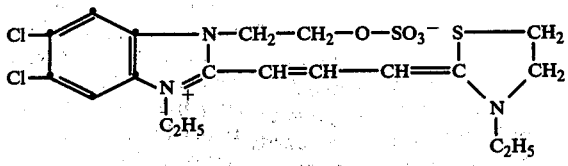

Table 2-continued
10.
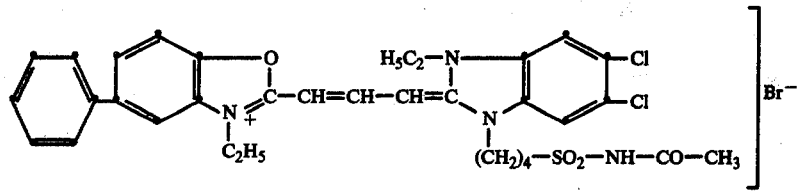
11.
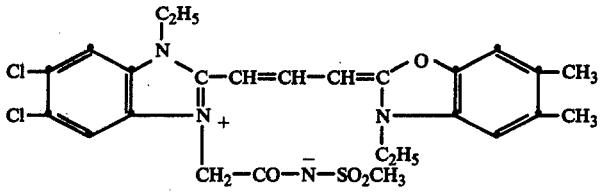
12.
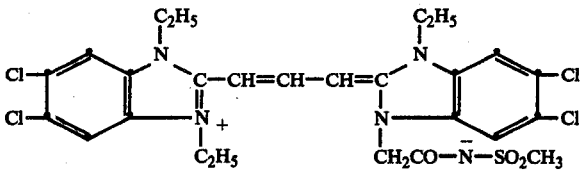
13.
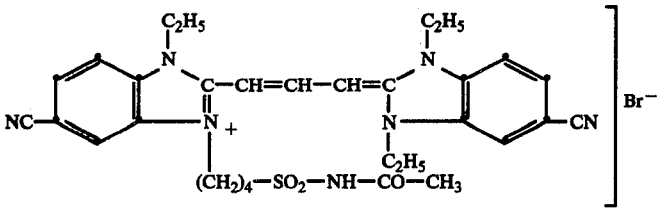
14.
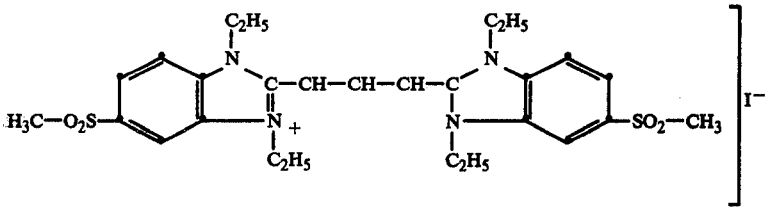
15.
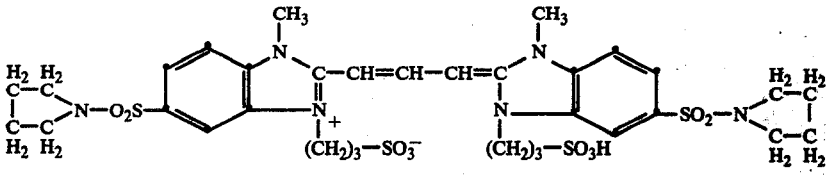
16.
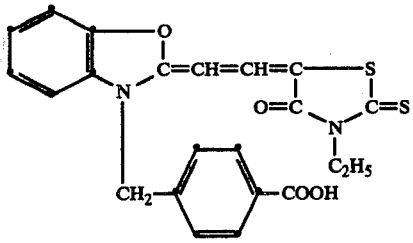
17.
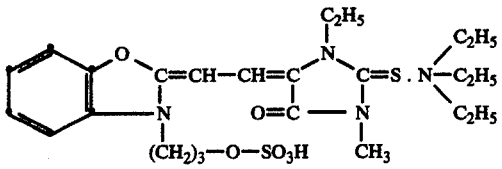
18.
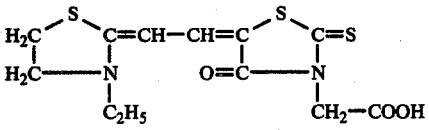

Table 2-continued

19.

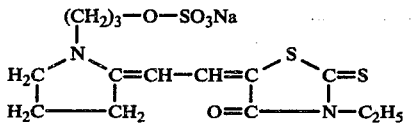

20.

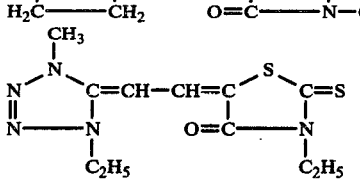

21.

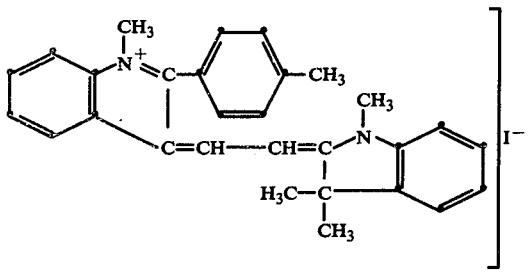

Supersensitization in the green spectral range may be obtained with the following compounds 22 and 23 of Table 2 in a molar ratio 1:2.

22.

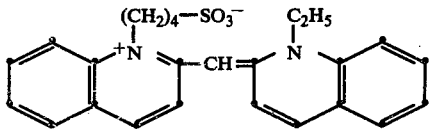

23.

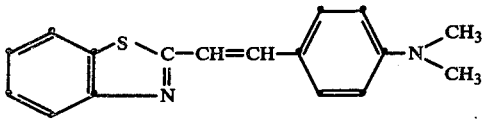

The silver halide in the emulsion layers(s) may comprise varying amounts of silver chloride, silver iodide, silver bromide, silver chlorobromide, silver bromoiodide, and the like, but when coated must be capable, after exposure and processing, of producing a negative silver image remaining thereon, i.e. in situ. Particularly good results are obtained with silver bromoiodide emulsions in which the average grain size of the silver bromoiodide crystals is in the range of about 0.1 to about 3 microns.

The measured covering power is greater than about 50 at maximum silver metal density as shown by the examples hereafter. Consequently, in the duplitized silver halide coating material, the total silver coverage per unit area for both coatings is less than about 8 gram per sq.m and preferably, each such coating contains less than about 4 gram of silver per square meter. In a preferred combination the silver halide layers contain together an amount of silver halide equivalent to about 6 to less than 8 gram of silver per sq.m. Preferred combinations of our invention have a silver halide-containing coating or coatings capable of transmitting less than about 40% and preferably less than about 30% of the incident radiation from the screen at wavelengths longer than 410 nm when said silver halide coverage is within the above ranges.

The proper transmittance is obtained mainly through the presence of the spectral sensitizing dye(s) and according to a preferred embodiment also through a blue dye incorporated in the support.

The image-forming silver halide emulsion may be chemically sensitized by any of the known procedures. The emulsions may be digested with naturally active gelatin or with small amounts of sulphur-containing compounds such as allyl thiocyanate, allylthiourea, sodium thiosulphate, etc. The image-forming emulsion may be sensitized likewise by means of reductors, e.g. tin compounds as described in the United Kingdom patent specification No. 789,823, polyamines e.g. diethyltriamine, and small amounts of noble metal compounds such as of gold, platinum, palladium, iridium, ruthenium, and rhodium as described by R. Koslowsky, Z. Wiss. Phot. 46, 67–72 (1951). Representative examples of noble metal compounds are ammonium chloropalladate, potassium chloroplatinate, potassium chloroaurate and potassium aurithiocyanate.

Emulsion stabilizers and antifoggants may be added to the silver halide emulsion before or after admixture of the low-speed emulsion, e.g., the known sulphinic and selenic acids or salts thereof, aliphatic, aromatic or heterocyclic mercapto compounds or disulphides, e.g. those described and claimed in published German patent application No. 2,100,622, preferably comprising sulpho groups or carboxyl groups, mercury compounds e.g. those described in Belgian patent specification Nos. 524,121 - 677,337 - 707,386 and 709,195 and tetra-azaindenes as described by Birr in Z. Wiss. Phot. 47, 2–58 (1952), e.g. the hydroxy tetraazaindenes of the following general formula :

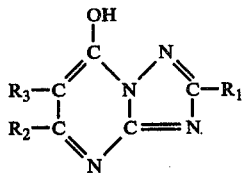

wherein :

each of $R_1$ and $R_2$ represents hydrogen, an alkyl, an aralkyl, or an aryl group, and $R_3$ represents hydrogen, an alkyl, a carboxy, or an alkoxycarbonyl group, such as 5-methyl-7-hydroxy-s-triazolo[1,5-a]-pyrimidine.

Other additives may be present in one or more of the hydrophilic colloid layers of the radiation-sensitive silver halide elements of the present invention, e.g. hardening agents such as formaldehyde, dialdehydes, hydroxy aldehydes, mucochloric and mucobromic acid, acrolein, and glyoxal, mordanting agents for anionic colour couplers or dyes formed therefrom, plasticizers and coating aids e.g. saponin, e.g. dialkylsulphosuccinic acid salts such as sodium diisooctylsulphosuccinate, alkylaryl polyether sulphuric acids, alkylarylpolyethersulphonic acids, carboxyalkylated polyethyleneglycol ethers or esters as described in French patent specification No. 1,537,417 such as iso-$C_8H_{17}$—$C_6H_4(OCH_2CH_2)_8OCH_2COONa$, fluorinated surfactants e.g. these described in Belgian patent specification No. 742,680 and the published German patent application Nos. 1,950,121 and 1,942,665, inert particles such as silicon dioxide, glass, starch and polymethylmethacrylate particles.

For the purpose of accelerating the development, the exposed photographic material is developed preferably in the presence of development accelerators. These development accelerators can be used either in the silver halide emulsion, in adjacent layer(s) or in the developing bath. They include alkylene oxide compounds of various types, e.g. alkylene oxide condensation products or polymers as described in U.S. Pat. Nos. 1,970,578 - 2,240,472 - 2,423,549 - 2,441,389 - 2,531,832 and 2,533,990 and in United Kingdom patent specification Nos. 920,637 - 940,051 - 945,340 - 991,608 and 1,015,023. Other development accelerating compounds are onium and polyonium compounds preferably of the ammonium, phosphonium, and sulphonium type for example trialkyl sulphonium salts such as dimethyl-n-nonyl sulphonium p-toluene sulphonate, tetraalkyl ammonium salts such as dodecyl trimethyl ammonium p-toluene sulphonate, alkyl pyridinium and alkyl quinolinium salts such as 1-m-nitrobenzyl quinolinium chloride and 1-dodecylpyridinium chloride, bis-alkylene pyridinium salts such as N,N'-tetramethylene bispyridinium chloride, quaternary ammonium and phosphonium polyoxyalkylene salts especially polyoxyalkylene bispyridinium salts, examples of which can be found in U.S. Pat. No. 2,944,900, etc.

After radiographic exposure the radiographic silver halide elements of the present invention are developed, preferably in an energetic surface developer. The high energy is required in order to allow the development to proceed quickly and may be obtained by properly alkalizing the developing liquid (pH 9–12), by using high-energy developing substances or a combination of developing substances, which as a consequence of their superadditive action is very energetic.

Economy on the silver halide in the emulsion is realized by building up the image density partly with dyes. Such may proceed by introducing (a) colour coupler(s) into the emulsion, which at least at the stage of the development form(s) (a) dye(s) with the oxidation product of an aromatic primary developing agent, e.g. of the p-phenylenediamine type, which dye(s) absorb(s) in the visible part of the spectrum.

Further it is known that a relatively high maximum density and contrast can be obtained even with a low amount of silver halide content per unit of surface when a colour image is produced together with a silver image as is described, e.g., in the published German patent application (D.O.S.) No. 1946652.

When applying a colour development preferably so-called 2-equivalent couplers are used to further reduce the consumption of silver thus only 2 instead of 4 molecules of exposed silver halide are necessary for the production of 1 dye molecule. Such couplers contain in the coupling position, e.g. a halogen atom such as iodine, bromine, or chlorine (see therefor e.g. the U.S. Pat. No. 3,006,759). The density of the image is thus realised by addition of the densities of the silver image(s) combined with the dye image(s).

For improving the information content retrieval those phenol or α-naphthol type colour couplers are particularly suitable that on colour development of the silver halide with an aromatic primary amino developing agent form a quinoneimine dye mainly absorbing in the red and also absorbing in the green and having an absorption maximum in the spectral wavelength range of 550 to 700 (ref. therefor is made e.g. to the published German patent application D.O.S. No. P 1946652).

Phenol couplers suited for that purpose correspond, e.g., to the following general formula:

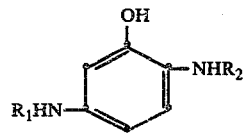

wherein:

each of $R_1$ and $R_2$ represents a carboxylic acid acyl or sulphonic acid acyl group including said groups in substituted state, e.g. an aliphatic carboxylic acid acyl group, an aromatic carboxylic acid acyl group, an heterocyclic carboxylic acid acyl group, e.g. a 2-furoyl group or a 2-thienoyl group, an aliphatic sulphonic acid acyl group, an aromatic sulphonic acid acyl group, a sulphonyl thienyl group, an aryloxy-substituted aliphatic carboxylic acid acyl group, a phenyl carbamyl aliphatic carboxylic acid acyl group, or a tolyl carboxylic acid acyl group.

For such types of phenol colour couplers and their preparation reference may be made to U.S. Pat. No. 2,772,162 and 3,222,176, to United Kingdom patent specification No. 975,773.

When colour images are prepared together with silver images, use is made of aromatic primary amino colour developing agents e.g. N,N-dialkyl-p-phenylenediamines and derivatives thereof, e.g. N,N-diethyl-p-phenylenediamine, N-butyl-N-sulphobutyl-p-phenylenediamine, 2-amino-5-diethylaminotoluene hydrochloride, 4-amino-N-ethyl-N(β-methane sulphonamidoethyl)-m-toluidine sesquisulphate monohydrate and N-hydroxy-ethyl-N-ethyl-p-phenylenediamine. The colour developer can be used together with black-and-white developing agents e.g. 1-phenyl-3-pyrazolidinone and p-monomethylaminophenol which are known to have a superadditive effect on colour development (see L.F.A. Mason, J.Phot.Sci. 11 (1963) 136–139), and other p-aminophenol derivatives, e.g. those according to French patent specification No. 1,283,420 such as 3-methyl-4-hydroxy-N,N-diethylaniline, 3-methyl-4-hydroxy-N-ethyl-N-β-hydroxyethylaniline, 1-methyl-6-hydroxy-1,2,3,4-tetrahydroquinoline, 1-β-hydroxyethyl-6-hydroxy-1,2,3,4-tetrahydroquinoline, N-(4-hydroxy-3'-methylphenyl)pyrrolidine, etc. It is also possible to use combinations of aromatic primary amino colour developing agents to obtain an increased rate of colour development (see e.g. German patent specification No. 954,311 and French patent specification No. 1,299,899); favourable effects are obtained e.g. by the use of N-ethyl-N-2-hydroxyethyl-p-phenylenediamine together with N-butyl-N-sulphobutyl-p-phenylenediamine, 2-amino-5-diethylamino-toluene hydrochloride or N,N-diethyl-p-phenylenediamine hydrochloride.

The developing solutions may also comprise any of the usual additional ingredients e.g. sodium sulphite and hydroxylamine or derivatives thereof, hardening agents, antifoggants e.g. benzotriazole, 5-nitro-benzimidazole, 5-nitro-indazole, halides such as potassium bromide, silver halide solvents, toning and intensifying compounds, solvents e.g. dimethylformamide, dimethylacetamide and N-methyl-pyrrolidone for chemical ingredients that are difficult to dissolve in the preparation of the developing solutions or that tend to precipitate upon standing, etc.

The radiation-sensitive emulsions for use in the present invention may be coated on a wide variety of supports e.g. films of cellulose nitrate, cellulose esters, polyvinylacetal, polystyrene, polyethylene terephthalate and other polyester materials as well as α-olefin-coated papers e.g. paper coated with polyethylene or polypropylene.

Preferred supports comprise a linear condensation polymer, blue coloured polyethylene terephthalate being an example thereof.

The supports used in the present recording materials may be coated with subbing layers for improving the adhesion of (a) gelatino-silver halide emulsion layer(s) thereto. As already mentioned the support may be coloured. According to the present invention blue dyes are preferred. Blue polyester resin supports are known from the prior art.

The mechanical strength of melt-extruded supports of the polyester type can be improved by stretching. In some cases as described in the United Kingdom patent application No. 1,234,755 the support may carry a subbing layer in the stretching stage.

Suited subbing layers are known to those skilled in the art of silver halide photography. With regard to the use of hydrophobic film supports reference is made to the composition of subbing layers described in the United Kingdom patent specification No. 1,234,755.

According to said specification a hydrophobic film support has (1) a layer which is directly adherent to the said hydrophobic film support and comprises a copolymer formed from 45 to 99.5% by weight of at least one of the chlorine-containing monomers vinylidene chloride and vinyl chloride, from 0.5 to 10% by weight of at least an ethylenically unsaturated hydrophilic monomer, and from 0 to 54.5% by weight of at least one other copolymerisable ethylenically unsaturated monomer; and (2) a layer comprising in a ratio of 1:3 to 1:0.5 by weight a mixture of gelatin and a copolymer of 30 to 70% by weight of butadiene with at least one copolymerisable ethylenically unsaturated monomer.

The exposed radiographic elements of the present invention are preferably processed in an automatic processing apparatus for X-ray films in which the photographic material may be guided automatically and at a constant speed from one processing unit to the other, but it will be understood by those skilled in the art that the radiographic image recording elements disclosed herein can also be processed apart from the above mentioned automatic processing apparatus in a variety of ways, such as by using the manual conventional multi-tank methods well known in the art.

For common emulsion preparation processes and the use of particular emulsion ingredients reference is made in general to the Product Licensing Index of December 1971 in which the following terms are dealt with in more details:

| | |
|---|---|
| I/II | Emulsion type and preparation of said element |
| III | Chemical sensitization |
| IV | Development modifiers |
| V | Antifoggants and stabilizers |
| VI | Developing agents |
| VII | Hardeners |
| VIII | Binding agents or polymers for silver halide layers and other layers |
| IX | Antistatic layers |
| X | Supports |
| XI | Plasticizers and lubricants |
| XII | Coating aids |
| XV | Spectral sensitization agents for silver halides |
| XXIII | Colour material ingredients |
| XVI | Absorbing and filter dyes |
| XXI | Physical development systems, and |
| XVII and XVIII | Addition agents and coating procedures. |

The following examples illustrate the present invention.

EXAMPLE 1

A radiographic colour material was prepared in the following way.

To 155 g of a high speed silver bromoiodide emulsion (9 mole % silver iodide) which comprises an amount of silver halide equivalent to 23.9 g of silver nitrate and 15.5 g of gelatin, and which has an average silver halide grain-size of 800 nm, 22.5 ml of a 0.5% methanolic solution of the following sensitizing dye were added:

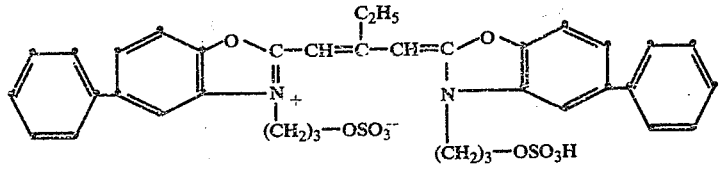

The covering power obtainable with said emulsion was 200.

Then, 200 g of a low speed silver chloride emulsion comprising an amount of silver chloride equivalent to 24 g of silver nitrate and 16.8 g of gelatin were added to the spectrally sensitized silver bromoiodide emulsion.

The low speed silver chloride emulsion was prepared by admixing an aqueous solution of silver nitrate to an aqueous gelatin/sodium chloride solution, precipitating the gelatin emulsion with ammonium sulphate, washing and peptizing. Gelatin was then added as well as 5-methyl-7-hydroxy-s-triazolo[1,5-a]pyrimidine so that no chemical ripening occurred. The mean grain-size of the silver chloride emulsion was 220 nm.

The mixture was molten by heating for 1 h at 38°C. whereupon were added:

(a) 14.5 g of the colour coupler having the formula:

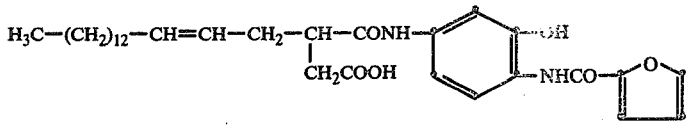

from an aqueous alkaline solution, (b) sufficient aqueous acetic acid solution to neutralize the emulsion (pH 7), (c) 5-methyl-7-hydroxy-s-triazolo[1,5-a]pyrimidine as emulsion stabilizer, (d) saponin as coating aid, and (e) mucochloric acid as hardening agent.

The emulsion was diluted to make 920 ml and then coated on both sides of a subbed polyethylene terephthalate support, the total surface of which is 10 sq.m. (2 × 5 sq.m). On both sides a gelatin antistress layer of 0.0015 mm was provided whereupon the radiographic colour material formed was dried.

The spectrally sensitized material has a sensitivity maximum at about 555 nm.

A material prepared under identical circumstances but without the addition of the spectrally sensitizing dye as well as the spectrally sensitized material were arranged between two fluorescent intensifying screens comprising as luminescent material gadolinium oxysulphide activated with terbium and the radiographic elements formed were exposed to 60 kV X-ray radiation through a lead bar test object in order to determine the relationship between speed and modulation transfer function value (MTF-value).

After removal of the intensifying screens the radiographic colour materials were automatically colour-processed, which includes colour-development (24 sec at 41° C.), fixing (20 sec at 41° C.), rinsing (25 sec at 41° C.) and drying (20 sec at 55° C.).

The developing bath used had a pH of 10.6 and comprised per liter: 8 g of N-hydroxyethyl-N-ethyl-p-phenylenediamine, 1.5 g of hydroxylamine, 4 g of anhydrous sodium sulphite, 1 g of potassium bromide, and 65 g of anhydrous potassium carbonate. Fixing occurred by means of a sodium thiosulphate fixing solution.

The measurements of the relationship between MTF-value and speed occurred by means of a microdensitometer and showed that for a same MTF-value, the spectrally sensitized material had a markedly higher speed than the non-spectrally sensitized material, namely about 320%.

It was also found that the combined use of the above luminescent screens with the spectrally sensitized radiographic colour material of the invention yields a move favourable relationship between MTF value and speed than the combined use of a non-spectrally sensitized radiographic colour element with conventional calcium tungstate screens.

EXAMPLE 2

A silver bromoiodide X-ray emulsion (1.5 mole % of silver iodide) was prepared in such a way that it contained silver halide grains with an average grain size of 0.60 μ and comprised per kg an amount of silver halide corresponding to 190 g of silver nitrate and 74 g of gelatin. As stabilizing agents the emulsion contained per kg 545 mg of 5-methyl-7-hydroxy-s-triazolo[1,5-a]pyrimidine, 6.5 mg of 1-phenyl-5-mercaptotetrazole, and 0.45 mg of mercury cyanide. The silver halide emulsion was spectrally sensitized for green light with a spectral sensitizing agent corresponding to the structural formula:

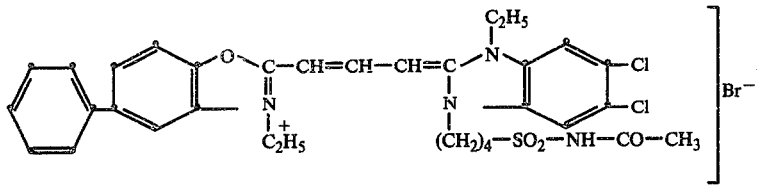

applied in an amount of 120 mg per mole of silver halide. The covering power obtainable with said emulsion was 60.

The above emulsion was coated on both sides of a double side subbed polyethylene terephthalate support in such a way that on each side of the support a silver halide emulsion layer was obtained containing an amount of silver halide equivalent to 6 g of silver nitrate per sq.m.

Each emulsion layer was coated with a gelatino antistress layer at a coverage of 1 g per sq.m.

A material prepared under identical circumstances but without the addition of the spectral sensitizing dye as well as the spectrally sensitized material were arranged between two fluorescent intensifying screens comprising as luminescent material gadolinium oxysulphide activated with terbium and the radiographic combinations formed were exposed to 60 kV X-ray radiation through a lead bar test object in order to determine speed and the modulation transfer function (MTF).

After removal of the fluorescent screen the radiographic materials were processed in an automatic 90 seconds processing machine, the development occurred for 23 seconds at 35° C. in Agfa-Gevaert's hardening developer G 138 which comprises hydroquinone and 1-phenyl-3-pyrazolidinone as developing agents and glutaraldehyde as hardener.

The measurement of the speed occurred by means of a densitometer and showed that the combination containing the spectrally sensitized material had a markedly higher speed than the combination containing the non-spectrally sensitized material namely about 320% higher.

It was also found that the combined use of the above luminescent screens with the spectrally sensitized radiographic material of the invention yields a more favourable relationship between MTF value and speed than the combined use of the same but non-spectrally sensitized radiographic element with conventional calcium tungstate screens.

Quantitatively the cross-over is defined as the percentage of light that is arriving from one fluorescent screen in the silver halide emulsion layer that in the double side coated material is present at the side opposite to said screen. The above combination of green light emitting screens with spectrally sensitized double side coated low silver halide content material (containing an amount of silver halide corresponding with 7.55 g of silver per sq.m) on a colourless base gives rise to a cross-over of 59% which is still acceptable from commercial viewpoint. When having the same green-sensitized silver halide emulsion layers coated on the blue coloured base used in the manufacture of CURIX RP1 film a cross-over of 44% is obtained.

A commercially available silver halide material-screen system such as blue base CURIX RP1 film combined with blue light emitting calcium tungstate screens has a cross-over of 51%.

Although the present invention is primarily described with reference to two separate fluorescent screens, each of which has more than half its spectral emissions above 410 nm and its maximum of emission in the wavelength range of 450–470 nm and an intensification factor of at least 20 at 40 kV and at least 25 at 80 kV, it is possible to employ only one such screen, obtaining less favourable results.

I claim:

1. A combination of photosensitive materials suited for radiography comprising:
   (1) two separate fluorescent screens each of which has more than half of its spectral emission above 410 nm and its maximum of emission in the wavelength range of 450–570 nm and an intensification factor of at least 20 at 40 kV and at least 25 at 80 kV,
   (2) a photosensitive material comprising a support and at both sides of said support a layer of silver halide, the silver halide being capable of yielding by development a visible, negative silver image, a covering power of more than about 50, and being present in each layer in a corresponding equivalent amount of less than about 4 g of silver per square meter and being spectrally sensitized with (a) sensitizing dye(s) in such a way that it is sensitive for light in the wavelength range of 450–570 nm, and each of said fluorescent screens being arranged adjacent to one of said emulsion layers.

2. The combination of claim 1, in which said screens contain fluorescent substances comprising elements with atomic number 39 or 57 to 71.

3. The combination of claim 2, in which said fluorescent substance is a rare earth oxysulphide or oxyhalide activated with other rare earth elements.

4. The combination of claim 3, in which said fluorescent substance is a lanthanum or gadolinium oxybromide or oxychloride activated with terbium or dysprosium or is a lanthanum or gadolinium oxysulphide activated with terbium and/or dysprosium.

5. The combination of claim 1, wherein the fluorescent screen contains a fluorescent substance corresponding to the following general formula:

$$M_{(w-n)}M'_nO_wX$$

wherein:

M is at least one of the metals yttrium, lanthanum, gadolinium or lutetium,

M' is at least one of the rare earth metals dysprosium, erbium, europium, holmium, neodymium, praseodymium, samarium, terbium, thulium or ytterbium, X is sulphur or halogen, n is 0.0002 to 0.2, and w is 1 when X is halogen or is 2 when X is sulphur.

6. The combination of claim 5, wherein the screen comprises a terbium-activated gadolinium or lanthanum oxysulphide having emission peaks at 490 and 540 nm.

7. The combination of claim 1, in which the fluorescent screen contains a mixture of:
   (A) yttrium oxysulphide activated with from 0.1 to 10% by weight of terbium or activated with terbium and dysprosium, and
   (B) gadolinium or lanthanum or lutetium oxysulphide activated with terbium or dysprosium.

8. The combinaton of elements according to claim 1, wherein the intensifying screen contains fluorescent particles dispersed in a binder within the range of 85–95% by weight.

9. A combination according to claim 1, wherein the intensifying screen contains the fluorescent particles having a grain size within the region of about 1–25μ.

10. A combination according to claim 1, wherein the silver halide has been sensitized with (a) spectral sensitizing dye(s) of the class of cyanine or merocyanine dyes.

11. A combination according to claim 1, wherein the silver halide is a silver bromoiodide having an average grain size in the range of about 0.1 to 3μ.

12. The combination described in claim 1, wherein the silver halide layers contain together an amount of silver halide equivalent to about 6 to less than about 8 g of silver per sq.m.

13. The combination of claim 1, wherein the photosensitive material contains a filtering dye or mixture of dyes that absorb in the wavelength range of 450 to 600 nm.

14. The combination of claim 1, wherein the photosensitive material contains a support having a blue colour.

15. The combination of claim 14, wherein the support absorbs in the wavelength range of 480–700 nm and has in that range a specular absorption density up to 0.45.

16. The combination of claim 15, wherein the blue support in the wavelength range of 500 to 580 nm has a specular absorption density in the range of about 0.1 to about 0.2.

17. The combination of claim 1, wherein the photosensitive material on both sides of its support has been coated with a silver halide emulsion layer and between said silver halide emulsion layers and/or in said emulsion layers (a) filtering dye(s) is (are) present that can be decolourized in one of the processing baths for the photosensitive silver halide material.

18. The combination of claim 17, wherein said filtering dyes are used in a hydrophilic colloid layer.

19. The combination of claim 1, wherein the fluorescent screen is in the form of a layer applied to a support or applied as a self-supporting layer or sheet.

20. The combination of claim 22, wherein the fluorescent screen contains fluorescent substances dispersed in a binder.

21. The combination of claim 1, wherein the X-ray fluorescent intensifying screen material contains (a) screening dye(s).

22. The combination of claim 21, wherein the screening dye or dyes are present in the layer containing the fluorescent substance(s).

23. The combination of claim 21, wherein the screening dye or dyes are present in a layer adjacent to the layer containing the fluorescent substance(s).

24. The combination of claim 21, wherein the screening dye is present in an anti-halation layer subjacent to the fluorescent layer.

25. The combination of claim 21, wherein the screening dye is Neozapon Fire Red (C.I. Solvent Red 119).

* * * * *